US007080825B1

(12) United States Patent
George et al.

(10) Patent No.: US 7,080,825 B1
(45) Date of Patent: Jul. 25, 2006

(54) CHAIN MOTOR DRIVE CONTROL SYSTEM

(75) Inventors: David W George, Compton, CA (US); Glenn R. Bracegirdle, Compton, CA (US); Joseph Peppard, Compton, CA (US); Thomas G. Booth, Compton, CA (US); Christopher E. Guth, Compton, CA (US)

(73) Assignee: George & Goldberg Design Associates, Compton, CA (US)

( * ) Notice: Subject to any disclaimer, the term of this patent is extended or adjusted under 35 U.S.C. 154(b) by 0 days.

(21) Appl. No.: 10/977,852

(22) Filed: Nov. 1, 2004

Related U.S. Application Data

(63) Continuation-in-part of application No. 10/821,429, filed on Apr. 9, 2004.

(51) Int. Cl.
*B66D 1/50* (2006.01)
*B66D 1/12* (2006.01)

(52) U.S. Cl. ..... 254/267; 254/276; 254/362; 254/375

(58) Field of Classification Search ..... 254/370, 254/372, 267, 268, 273, 274, 275, 276, 358, 254/362
See application file for complete search history.

(56) References Cited

U.S. PATENT DOCUMENTS

| | | | | |
|---|---|---|---|---|
| 219,237 | A | 9/1879 | Ennett | |
| 697,772 | A | 1/1902 | Allison | |
| 2,477,783 | A | 8/1949 | Britt | |
| 2,991,976 | A | 7/1961 | Carroll | |
| 3,309,066 | A * | 3/1967 | Carlson et al. | 254/268 |
| 3,584,838 | A | 6/1971 | Tampin | |
| 3,960,362 | A * | 6/1976 | Griffiths et al. | 254/276 |
| 4,005,852 | A | 2/1977 | Schmitmeyer et al. | |
| 4,175,727 | A | 11/1979 | Clarke | |
| 4,361,312 | A * | 11/1982 | Schreyer et al. | 254/276 |
| 4,905,848 | A | 3/1990 | Skjonberg | |
| 5,160,852 | A | 11/1992 | Charles et al. | |
| 5,167,400 | A * | 12/1992 | Gazel-Anthoine | 254/275 |
| 5,299,780 | A | 4/1994 | Sugiyama | |
| 5,566,925 | A | 10/1996 | Wada et al. | |
| 5,790,407 | A | 8/1998 | Strickland et al. | |
| 6,209,852 | B1 | 4/2001 | George et al. | |
| 6,386,513 | B1 * | 5/2002 | Kazerooni | 254/270 |
| 6,547,220 | B1 * | 4/2003 | Johnson | 254/331 |
| 6,600,289 | B1 * | 7/2003 | George et al. | 318/727 |
| 2003/0127635 | A1 * | 7/2003 | Morse et al. | 254/268 |

* cited by examiner

*Primary Examiner*—Kathy Matecki
*Assistant Examiner*—Evan Langdon
(74) *Attorney, Agent, or Firm*—Charles H. Thomas

(57) ABSTRACT

An improved chain motor drive controller is provided for a chain hoist. The system employs a position encoder including a position sensor located within the casing of the chain hoist to producing encoded electrical position signals. A motor pulley is mounted on the chain motor rotary drive shaft and is coupled by a cogged belt to rotate an encoder pulley that is mounted on the same shaft as the position sensor. A mechanical coupling is thereby provided entirely within the casing of the chain hoist to transmit rotary motion from the rotary drive shaft directly to the position sensor. Also, tracking circuitry, likewise located entirely within the chain hoist casing, receives electrically encoded destination signals and compares these to signals from the position sensor. The tracking circuitry accelerates rotation of the chain motor drive shaft starting from a stationary condition and decelerates rotation of the chain motor drive shaft as the differences between the encoded position signals and the encoded destination signals approach zero.

4 Claims, 7 Drawing Sheets

CHAIN MOTOR DRIVE CONTROL SYSTEM

The present application is a continuation in part of U.S. application Ser. No. 10/821,429 filed Apr. 9, 2004, presently pending.

BACKGROUND OF THE INVENTION

1. Field of the Invention

The present invention relates to a chain hoist motor drive controller which is housed entirely within the casing of a chain hoist to track and control the movement of the load carried by the chain hoist relative to a fixed location.

2. Description of the Prior Art

Chain hoists are utilized in many different applications to raise and lower loads suspending from overhead supports. A chain hoist is comprised of a heavy-duty motor housed within a rugged casing and having at least one chain access opening in the casing. A chain may be suspended from an overhead support or from the chain hoist itself to carry a load. In either case the chain is routed around a chain drive gear located within the chain hoist casing. The chain drive gear within the casing is driven by the chain hoist motor. The slack portion of the chain, after passing around the drive gear within the casing, is routed back out through the chain opening and hangs from the chain hoist casing as a slack end having a length that varies with the position of the chain hoist casing relative to the overhead support or with the position of the load relative to the chain hoist casing.

The chain hoist motor, through an internal chain drive gear within the casing, pulls either the load or the motor casing vertically upward, or allows the load or chain motor casing to travel vertically downward. The travel of the chain hoist casing or the load vertically up and down is controlled by switches located remotely from the chain hoist casing and coupled to the chain hoist motor by means of an electrical control cable. One or more hooks that are attached to the chain motor casing suspend a load beneath the chain hoist casing. This load is raised and lowered, under the control of the chain hoist operator, by the upward and downward travel of the load or the chain hoist along the portion of the chain which is under tension and from which the load or chain hoist is suspended. This travel occurs by pulling chain in and playing chain out from the casing. One such conventional chain hoist is described in U.S. Pat. No. 2,991,976, while another is described in U.S. Pat. No. 3,960,362.

Chain hoists are utilized extensively and in widely differing applications. They are used in shops, factories, warehouses, shipyards, and numerous other types of commercial and industrial establishments. In many applications of commercially available chain hoists the position of the chain hoist motor and casing relative to the length of the suspended chain upon which it travels or the position of the chain which travels relative to it may be controlled merely by observing either the chain hoist itself, or the load suspended from it. Adjustments to the vertical position of the chain or chain hoist may be performed merely by providing manual inputs to the chain hoist control switches. Indeed, a simply manually operated control is sufficiently accurate for many, many chain hoist applications that do not require precise position control.

On the other hand, there are some applications in which precision control of the chain hoist is required. In the theatrical industry, stage sets and props are often moved vertically utilizing general purpose chain hoists, but this movement must be controlled with great precision. For example, different portions of a stage prop may be moved vertically relative to the stage and relative to each other in a closely controlled and intricate sequence and at precise speeds in order to produce special theatrical effects. Precision control of general purpose chain hoists is often necessary in other applications as well. For example, precision control of a general purpose chain hoist may likewise be required at trade shows and expositions in order to create special effects or in order to move interdependent loads in a complex manner. Where precision control of a chain hoist is necessary, visual observation and corresponding adjustment utilizing manual controls is very inadequate and unacceptable.

To provide the necessary precision control for specific applications of general purpose chain hoists, various position-encoding systems have been devised. However, all of these conventional systems have certain drawbacks.

One prior art conventional system is described in U.S. Pat. No. 4,905,848. This system employs magnetic sensors on a pulley located externally of a motor in order to provide position information so as to guide the motor to move a load to a proper destination. However, errors are introduced into this system due to stretching of the cable or twisting of the chain, depending upon the load and its orientation. Furthermore, because the system operates at a single speed, there is a jarring or bounce that occurs when the load arrives at its destination and the motor is shut off.

Another prior system is described in U.S. Pat. No. 5,790,407. This system employs magnetic or optical sensors located on a cable take-up reel and entails the same problems of discrepancies between the position as sensed by rotation of the take-up reel and the actual position which is determined by rotation of the chain hoist motor shaft. This prior system also operates the motor at a single speed, either full on or completely off. Consequently, the load is subjected to a jarring or bouncing effect both when it is initially moved from a stationary position and also when it arrives at its destination.

Furthermore, the prior systems for operating chain hoists require a considerable amount of hardware and electrical components that must be packed separately and transported separately from the chain hoist itself.

SUMMARY OF THE INVENTION

The present invention provides a chain hoist motor control system that is housed entirely within the existing casings of the most popular commercially available chain hoists that are most frequently used in moving theatrical equipment. Consequently, the chain hoist motor control system of the present invention is protected from damage and from being misplaced during transportation and storage. The chain hoist motor control system of the invention is protected by the sturdy casing of the chain hoist and cannot become separated from the chain hoist or misplaced.

Furthermore, the position sensing apparatus for the chain hoist motor controller of the invention is considerably more accurate than conventional systems because the positional information is derived from the chain hoist motor shaft itself through a direct, mechanical connection between the rotary drive shaft of the chain drive motor and the position sensor of the position encoder.

In one broad aspect the present invention may be considered to be an improvement in a chain hoist having a casing housing a bidirectional chain drive motor including a rotary drive shaft within the casing. According to the improvement of the invention a position encoder, including a position sensor, is also located within the casing to produce encoded electrical position signals. In addition, a mechanical coupling is also located within the casing and is joined to transmit rotary motion from the rotary drive shaft directly to the position sensor.

The direct physical coupling between the chain drive motor shaft and the position sensor of the position encoder may take several different forms, such as a meshed gear system or a system of linkages and cranks. Preferably, however, the physical coupling of the chain drive motor shaft to the position sensor is achieved through the provision of a cogged motor pulley mounted on the chain motor rotary drive shaft, a cogged encoder pulley mounted in coplanar relationship with the motor pulley, and a cogged pulley drive belt engaged with both the motor pulley and the encoder pulley.

A pulley and drive belt coupling system is particularly advantageous since in conventional, commercially available chain drives there is a retaining nut at the end of the chain hoist motor rotary drive shaft opposite the chain-engaging mechanism. The kind of motor pulley utilized according to the invention is internally threaded and is engaged on the end of the motor drive shaft in place of the retaining nut. The motor pulley thereby serves the dual function of a retaining nut and also part of the mechanism that transmits rotary motion from the rotary drive shaft directly to the position sensor of the position encoder. By physically or mechanically coupling the movement of the chain drive motor rotary drive shaft directly to the position sensor the system of the invention achieves greater sensitivity to movement and exerts much tighter control over the movement and location of the chain hoist as compared with conventional systems.

The entire mechanical coupling mechanism that transmits rotary motion from the rotary drive shaft to the position sensor is located entirely within the existing casing of the chain hoist. This feature is particularly advantageous since chain hoists of the type utilized in the motion picture industry to move theatrical lighting and other equipment are frequently moved from one location to another. For protection and convenience of handling chain hoists are packed within form fitting shipping cases that have interior, padded surfaces configured to snugly seat the chain hoist casings within the shipping cases. There is no room in the shipping cases for any auxiliary equipment, such as separate housings for a mechanical coupling or a chain motor drive controller. Consequently, such ancillary equipment is typically packed and moved in different containers. However, since such auxiliary equipment is packed and moved separately, there is always the problem of locating it and reattaching it to the chain hoist once the chain hoist arrives and is to be deployed at a new location.

The present invention solves this problem by locating both the mechanical coupling that transmits rotary motion from the rotary drive shaft directly to the position sensor and also the chain motor drive controller physically within the chain hoist casing. This arrangement not only protects the mechanical coupling mechanism and chain motor drive controller from becoming lost or separated from the chain hoist, but also physically protects it from damage since it is housed within the existing sturdy chain hoist casing.

The chain motor drive controller of the present invention has other very significant advantages as well. The chain motor drive controller of the present invention operates at a variable speed in such a manner as to accelerate rotation of the chain drive motor rotary drive shaft when commencing movement from a stopped position and to decelerate rotation of the chain drive motor rotary drive shaft when the difference between the chain hoist location as determined by the position sensor and the desired destination approaches zero. That is, the driving signals to the chain hoist motor ramp up when the chain hoist is first moved and ramp down as it approaches its destination. Furthermore, the variable speed control of the invention allows the chain motor to creep slowly to a desired destination. This allows a suspended load to be held and moved much more steadily than is possible with conventional chain motor drive controller systems. The present invention avoids shaking or bouncing of the load that is characteristic of conventional chain hoist controllers, particularly at the commencement and at the cessation of repositioning.

In another broad aspect the invention may be considered to be another improvement in a chain hoist having a casing with a bidirectional chain drive motor therein that has a rotary drive shaft. Specifically, this improvement is comprised of a position encoder located within the casing including a position sensor producing encoded electrical position signals in response to rotation of the drive shaft. The improvement also is comprised of tracking circuitry that is also located within the casing for receiving electrically encoded destination signals from a source located externally of the casing end for receiving the encoded position signals. The tracking circuitry provides electrical encoded motor driving signals responsive to differences between the encoded position signals and the encoded destination signals. The motor driving signals accelerate rotation of the chain motor drive shaft starting from a stationary condition and decelerate rotation of the chain motor drive shaft as the differences between the encoded position signals and the encoded destination signals approaches zero.

Preferably, the electrical encoded motor driving signals of the tracking controller are digital signals and the system also includes an isolation amplifier and converter circuit coupled to receive the digital electrically encoded motor driving signals and convert them to actuating signals. An alternating current drive controller is coupled to receive the actuating signals from the isolation amplifier and converter circuit so as to provide alternating current power outputs to the bidirectional chain drive motor in response to the actuating signals.

The reason for providing the isolation amplifier and converter circuit is that the digital encoded motor driving signals produced by the tracking controller are pulse width modulated, square wave digital signals that have either a "high" or a "low" value. These motor driving signals are at very low voltage and current levels suitable for digital signal processing, but not nearly great enough for driving the chain drive motor. The isolation amplifier and converter circuit preferably includes optic couplers and in effect serves as an electrical adapter to allow the digital drive outputs from the tracking circuitry to operate the chain drive motor.

The chain hoist of the invention is further preferably comprised of a motor brake for preventing rotation of the bidirectional chain drive motor. The motor brake is operated by the alternating current drive controller which applies the motor brake to prevent rotation of the chain drive motor shaft when the differences between the encoded position signals from the position sensor and the encoded destination signals transmitted through the tracking circuitry approaches zero. A brake relay is preferably provided between the alternating current drive controller and the brake to actually operate the motor brake by opening and closing brake calipers or pads.

A further advantageous feature of the invention is the provision of an encoder-responsive circuit coupled to receive the encoded position signals and the encoded destination signals and connected to the alternating current drive controller and in parallel with the tracking circuitry. The alternating current drive controller responds to the tracking circuitry until and unless the differences between the encoded position signals and the destination signals falls to zero, whereupon the encoder responsive circuit overrides the tracking controller and operates the alternating current drive controller to stabilize and hold the chain drive motor at zero speed until and unless the tracking circuitry receives new destination signals.

While the tracking circuitry will also hold the chain drive motor at a zero speed when the chain hoist arrives at its destination, without the encoder-responsive circuit there is a certain amount of "hunting" that can occur which results in a jiggling of the load. Also, when a new destination is programmed into the system to start operation of the chain hoist motor from a static or stationary condition, there is a very slight delay in the circuit loop through the tracking circuitry. As a result, upon actuation of the chain hoist motor there is a tendency for the chain hoist to drop a short distance, typically about two inches. By overriding the tracking circuitry using the encoder-responsive circuit when the chain hoist is at its destination, both of these problems are largely eliminated.

A further advantage is achieved in a preferred embodiment of a chain hoist according to the invention by providing the motor with at least one brake. The brake is applied to prevent rotation of the motor drive shaft in the absence of a power actuating signal that releases the brake. The use of a brake thereby provides the motor with a safety feature.

Furthermore, in some geographic locations a redundant brake system is required. That is, in certain uses at certain geographic locations a chain hoist must be provided with at least a pair of brakes. Moreover, it is further required that the brakes be operated sequentially so that first and second audible sounds can be detected to ensure that both brakes have been sequentially applied.

A preferred embodiment of the present invention provides such a sequential braking system that ensures the proper application of the motor brakes.

Preferably also, the system is provided with a slip clutch between the motor rotary drive shaft and a chain drive output drive shaft. The use of a slip clutch limits the amount of overtorquing permitted. That is, the motor rotary drive shaft is limited to picking up only a certain percentage over the rated load. For example, the slip clutch can be installed so as to allow the motor to only pick up one hundred twenty-five percent of the rated load.

A further feature of this arrangement in a redundant motor braking system employs a second encoder that monitors the rotation of the chain drive output shaft, and a comparator or encoder mismatch detection circuit that is coupled to receive both the encoded electrical position signals of the motor rotary drive shaft and also signals indicative of the chain drive output shaft. If an encoder mismatch is detected a relay is actuated to sequentially terminate power to the duplicate motor brakes, one after the other, so that they are sequentially applied.

The invention may be described with greater clarity and particularity by reference to the accompanying drawings.

DESCRIPTION OF THE EMBODIMENT

Figure 1:
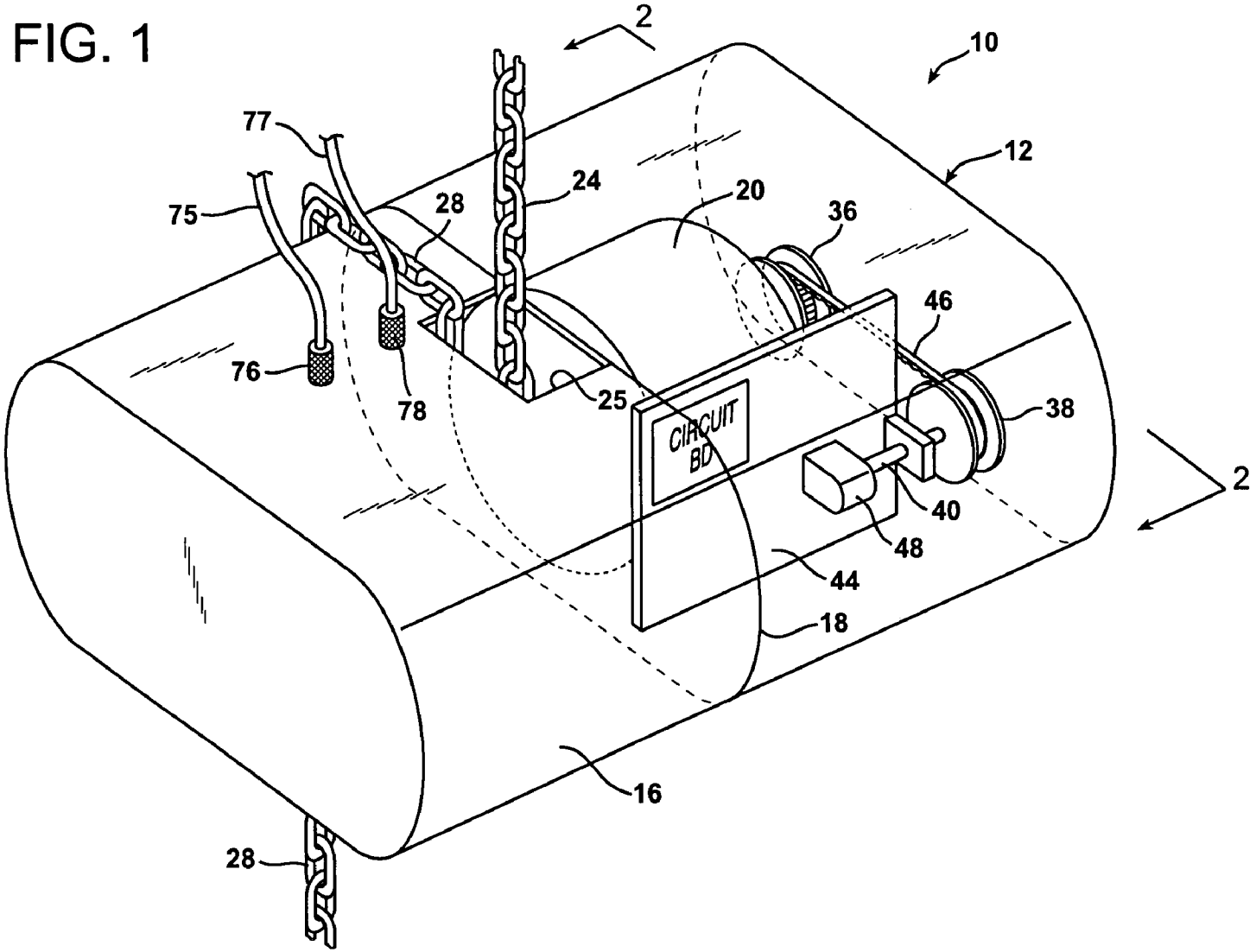
FIG. 1 is a perspective view illustrating an improved chain hoist according to the invention.

FIG. 1 illustrates a conventional general purpose chain hoist 10 of the type widely utilized in the theatrical industry for moving lights, scenery, and other heavy loads. For example, the chain hoist 10 may be a CM Lodestar one ton Model LL chain hoist sold by Columbus McKinnon Corp., located at 140 John James Audubon Parkway, Amherst, N.Y. 14228-1197. However, it is to be understood that the invention is not limited to use with this particular chain hoist. To the contrary, the control system of the invention may be utilized with many different commercially available chain hoists.

The chain hoist 10 has operating components housed within a casing 12 formed of a mating pair of rugged, durable casing shell portions 14 and 16 that fit together and meet at an interface demarcation 18. The casing shell portions 14 and 16 are secured to each other in a conventional manner by screws and bolts (not shown). Together, the shell sections 14 and 16 form an encapsulated casing that houses a heavy-duty, bidirectional, variable speed chain drive motor 20. The chain drive motor 20 has a rotary drive shaft 22, one end of which is visible in FIG. 2. At its opposite end the drive shaft 22 operates a conventional chain-engaging mechanism (not visible).

The chain hoist 10 hangs suspended from an overhead support by means of a length of chain 24 that enters the chain hoist casing 12 from above through a window 26 defined in the casing shell section 16. The length of chain 24 is engaged by the chain-engaging mechanism within the casing 12 so that the chain hoist 10 is held suspended at a desired height. A hook 26 or other attachment mechanism holds a load suspended beneath the chain hoist 10. The trailing tail 28 of the chain emerges from the chain-engaging mechanism within the casing 12 through the window 26 and hangs over an outboard edge of the chain hoist casing 12, as illustrated in FIGS. 1 and 2.

When the chain drive motor 20 is driven to raise the load suspended from the hook 26, the chain motor rotary drive shaft 22 is operated to turn in rotation in one direction to advance links of the load-bearing length 24 of chain onto the tail 28 of the chain, thereby causing the chain hoist 10 to climb up the load-bearing length 24 of chain, thus raising the load 12. When the load is to be lowered, the chain drive motor 20 is operated in the opposite direction so that the rotary drive shaft 22 transfers links of the chain from the trailing chain tail 28 onto the lower end of the vertically suspended, load-bearing length of chain 24, thereby increasing that length so that the chain hoist 10 descends down it. The operation of the chain hoist 10 is conventional, and need not be described in great detail.

Figure 2:
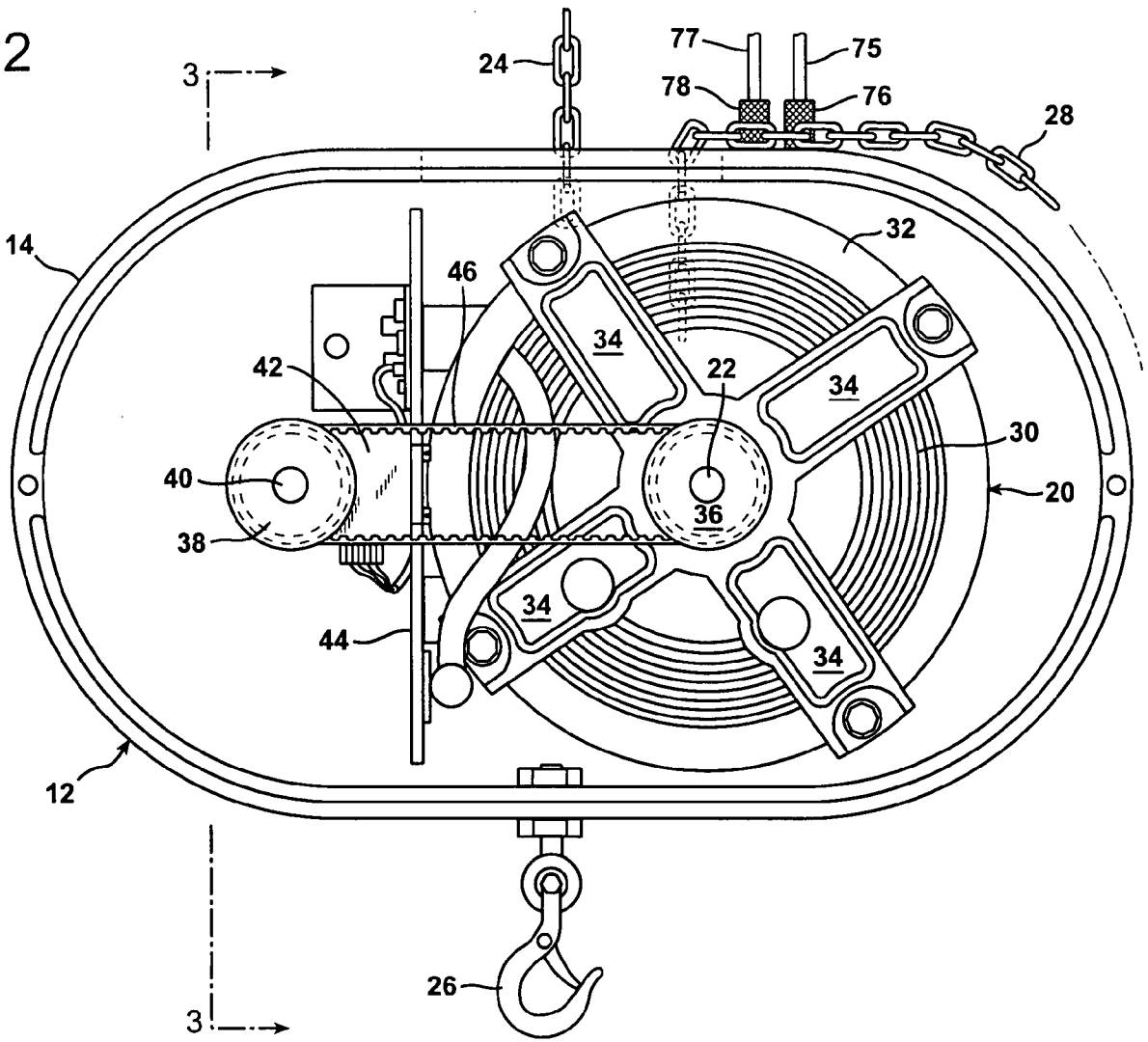
FIG. 2 is a sectional elevational view taken along the lines 2—2 of FIG. 1.

As illustrated in FIG. 2, the motor 20 is comprised of windings 30 within a generally cylindrical motor housing 32. The distal end of the chain drive motor drive shaft 22 is visible in FIG. 2 and protrudes beyond the intersection of support arms 34 arranged in a cruciform configuration. The end of the chain drive motor drive shaft 22 that is visible in FIG. 2 is externally threaded to receive a conventional retaining nut. However, according to the improvement of the invention the conventional retaining nut is removed and replaced with an externally cogged motor pulley 36, preferably having twenty teeth and a diameter of 1.5 inches.

A cogged encoder pulley 38 also having twenty teeth and of the same diameter is supported on a position sensor shaft 40 that is oriented parallel to and laterally displaced from the chain motor rotary drive shaft 22. A U-shaped mounting bracket 42 supports the position sensor shaft 40 upon a mounting plate 44 that is anchored to the motor housing 32. The mounting plate 44 lies between and is parallel to both the chain motor drive shaft 22 and the position sensor shaft 40. A flexible, cogged or toothed drive belt 46 is engaged in a loop with both the cogged pulleys 36 and 38. Together, the cogged pulleys 36 and 38 and the cogged drive belt 46 form a mechanical coupling that is joined to transmit rotary motion from the rotary drive shaft 22 to a conventional, optical position sensor indicated at 48 in FIG. 3. It should be noted that all of the components of this mechanical coupling are located entirely within the chain hoist casing 12.

Figure 3:
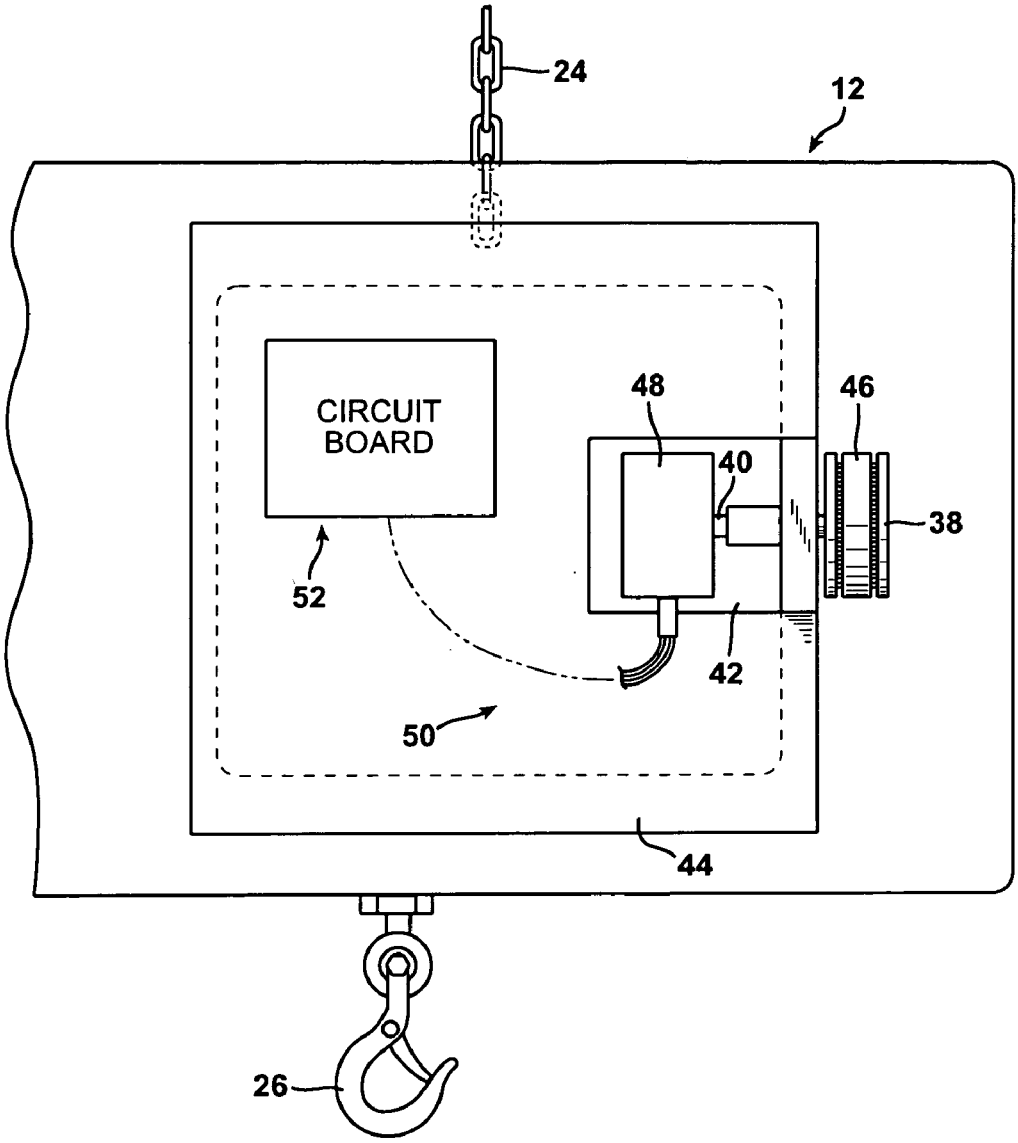
FIG. 3 is a sectional elevational view taken along the lines 3—3 of FIG. 2.

The position sensor 48 forms a part of a position encoder indicated generally at 50 in FIG. 3, which in turn forms a portion of the electrical chain motor drive controller for the chain hoist 10. Many of the remaining components of the chain motor drive controller of the invention are located on the circuit board 52, which is also mounted upon the mounting plate 44 entirely within the casing 12. The primary electrical components of the chain motor drive controller of the invention are illustrated schematically in FIGS. 4A and 4B.

In addition to the position encoder 50 and the direct mechanical drive coupling including the pulleys 36 and 38 and drive belt 46, the chain motor drive controller of the invention includes a tracking controller 54, a digital-to-analog conversion circuit 56, an isolation amplifier and converter circuit 58, and an alternating current drive controller 60. The chain motor drive controller also includes a motor brake 62, a brake relay circuit 64, a reactor 66, and an encoder responsive circuit 70. There is also an upper limit switch 72 and a lower limit switch 74. The upper limit switch 72 operates to shut off power to the motor 20 when the chain hoist has ascended up the chain to a maximum height established by a limit signal transmitted from a remote computer. The lower limit switch 74 operates to shut off power to the motor 20 when the chain hoist has descended down the chain to a maximum limit established by a limit signal transmitted from a remote computer. All of these components are located within the chain hoist casing 12.

Figure 4A:
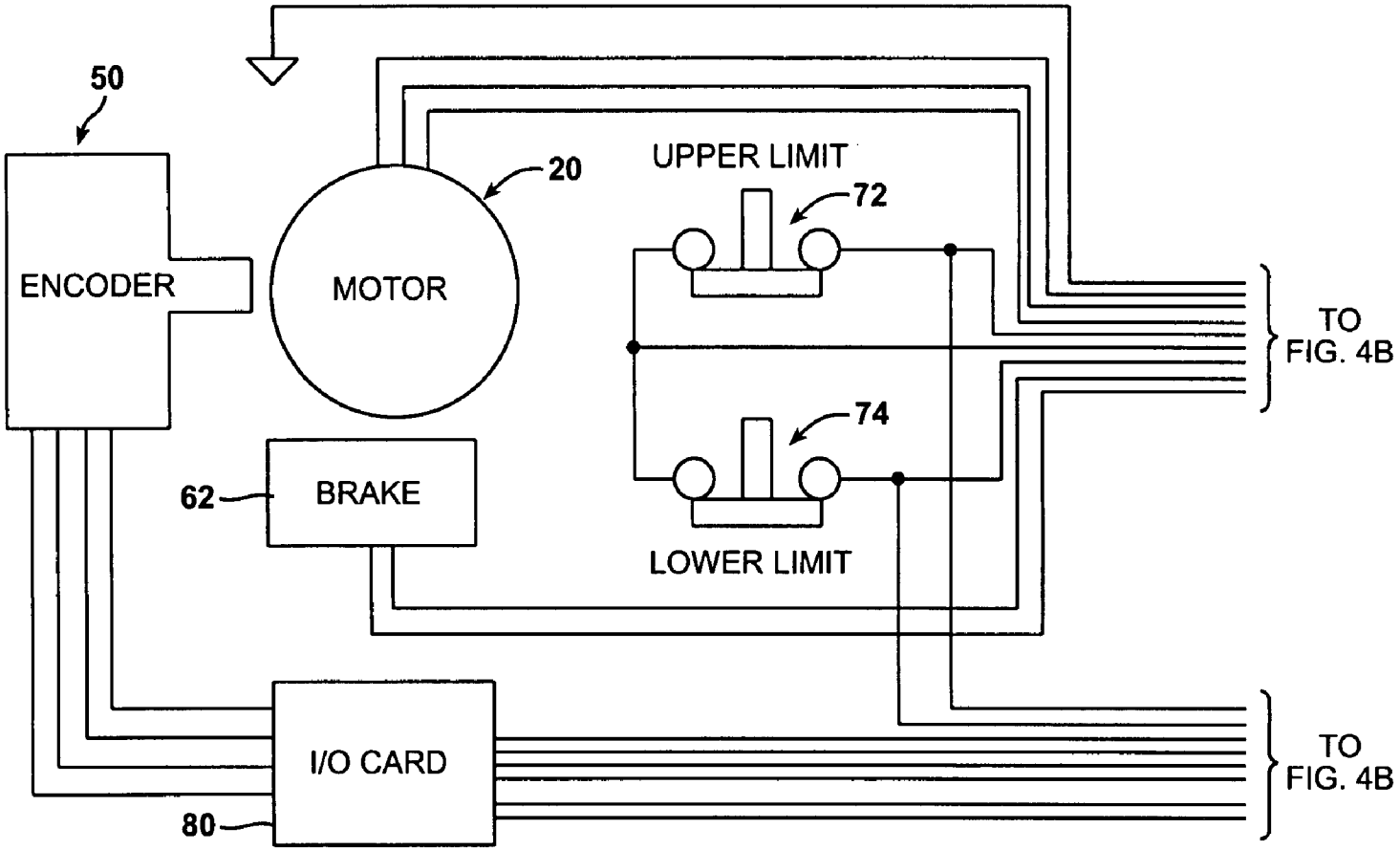
FIG. 4A is an electrical schematic diagram of one portion of the electrical circuitry of one embodiment of the chain motor drive controller of the invention.
Figure 4B:
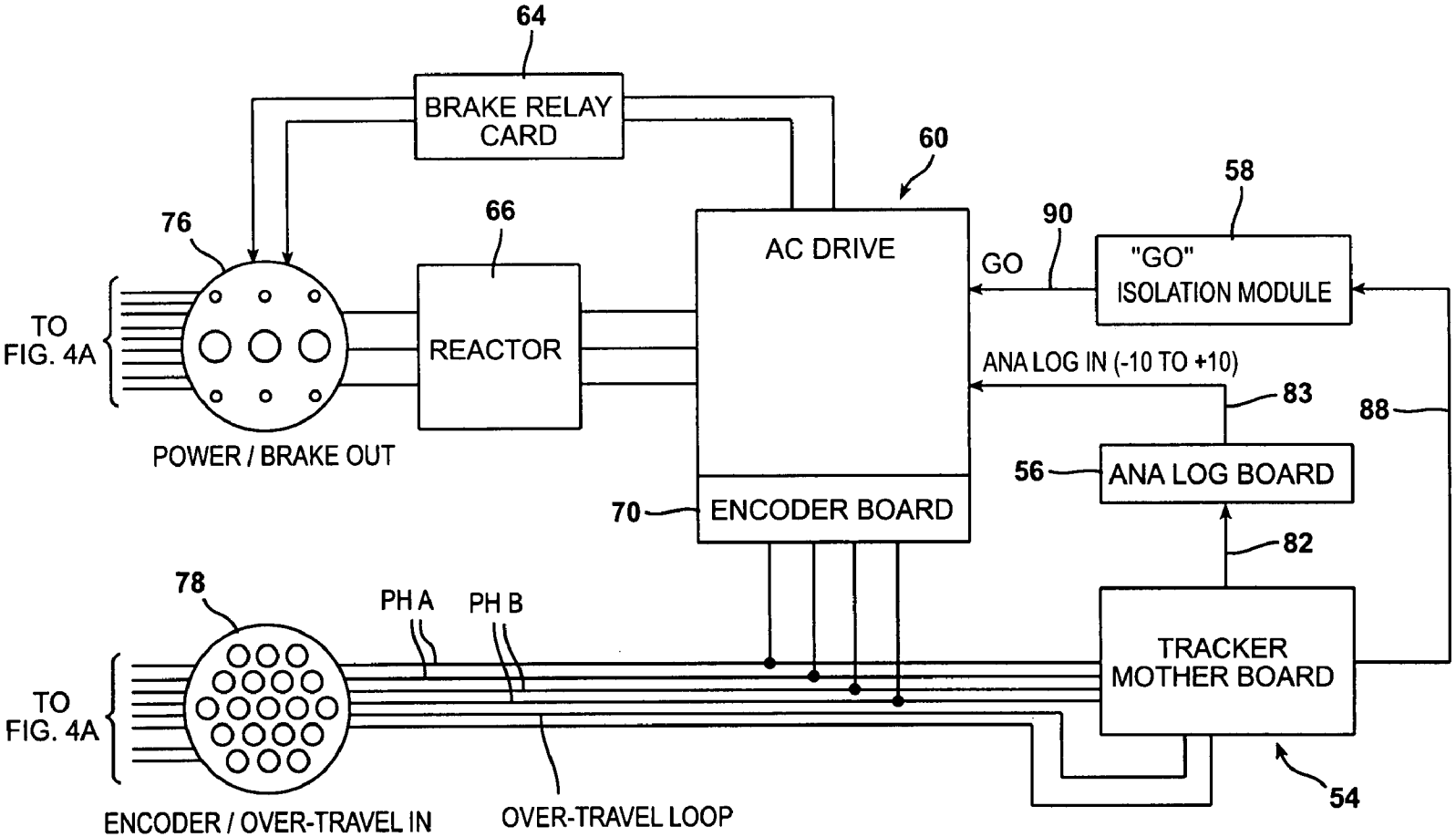
FIG. 4B is an electrical schematic diagram of the remaining portion of the electrical circuitry of the embodiment of the chain motor drive controller of the invention of FIG. 4A.

Brake power and motor power are provided to the chain hoist 10 through an umbilical connecting cable 75 that is attached to the casing 12 by a nine pin plug connection 76, visible in FIG. 1 and illustrated diagrammatically in FIG. 4B. Control signals are communicated to and from the chain motor drive controller of the invention by means of a signal cable 77 that is connected to a conventional computer controller and which interfaces with the chain hoist 10 by means of a nineteen pin signal plug 78, visible in FIG. 1 and indicated schematically in FIG. 4B.

The position encoder 50, which includes the position sensor 48, may be either a magnetic or optical encoder. One suitable encoder that made the employed is the U.S. Digital Encoder, Model S1-1024-B. The encoder 50 produces digital outputs that are amplified and converted by an input/output circuit 80 into two different pulse trains on two sets of signal wires. The input/output circuit 80 detects the zero to five volt signals from the encoder 50 and converts them to balanced line signals while filtering out noise. The two pulse trains from input/output circuit 80 are designated Phase A (abbreviated PH A) and Phase B (abbreviated PH B) in FIG. 4B. These two trains of pulses are ninety degrees out of phase and indicate the direction of rotation of the motor shaft 22. That is, rotation of the motor drive shaft 22 in one direction causes pulse train PH A to lead pulse train PH B. Rotation of the motor drive shaft 22 in the opposite direction causes pulse train PH B to lead pulse train PH A. Both pulse trains are transmitted through the signal plug connection 78 and through the signal cable 77 to a conventional remotely located computerized control system.

A destination for the chain hoist 10 is transmitted to the chain motor drive controller of the invention through inputs that are determined by the system operator and provided through a remotely located computer. These destination inputs are transmitted from the computer on wires in the signal cable 77 and are received at the signal plug 78, where they are transmitted to the tracker controller or "tracker motherboard" 54 indicated schematically in FIG. 4B.

The tracker control 54 preferably utilizes motion controlled chip sets, Model MC1401A I/O and MCX1401A CP sold by Performance Motion Devices. The destination signals transmitted to the tracker control 54 are preferably provided as a DMX data stream, which is the standard utilized in the entertainment industry for the lighting protocol for intensity and movement of lights. The tracker controller 54 contains tracking circuitry that receives the digitized electrical position outputs generated by the encoder 50, and processed through the remote computer control system. The tracker controller 54 also receives the destination position signals provided from the remote computer through wires in the signal cable 77 that are received at the chain hoist 10 through the signal plug 78. The tracker controller 54 compares the processed electrical position outputs from the encoder 50 and the destination position inputs from the remote computer and provides drive outputs on line 82 to the digital-to-analog converter 56, labeled "ANALOG BOARD" in FIG. 4B.

Unlike conventional chain motor drive controls, the tracker controller 54 ramps up its drive outputs so as to accelerate rotation of the chain motor drive shaft 22 upon movement of the chain motor drive shaft 22 from a stopped condition to a rotating condition. This gradual increase in the drive outputs avoids a sudden jerking of the load as the chain hoist drive motor 20 begins to operate from a zero speed condition. The digital drive signals on line 82 are converted to analog signals that increase the speed of rotation of the motor shaft 22 from zero to full speed in either direction, which is indicated by the designation +10 or −10 in FIG. 4B.

Conversely, as the tracker control 54 determines that the difference between the position signals received from the position sensor 48 in the encoder 50 and the destination signals commanded by the computer is approaching zero, the digital drive outputs on line 82 to the analog converter 56 decelerate from a value of ±10 to zero as the actual position of the chain hoist 10 approaches the destination position dictated by the remote computer. The digital-to-analog converter 56 thereby directs the alternating current drive circuit 60 to operate the motor 20 at the designated speed from full foreword to full reverse.

The tracker control 54 remains in a closed loop feedback control mode of operation throughout, and unlike the prior system of U.S. Pat. No. 4,905,848 does not release control and depend upon inertia to bring the chain hoist 10, and hence the suspended load, to the desired position. To the contrary, by operating the motor 20 at a variable speed to accelerate from a stopped condition and decelerate to a stopped condition, the chain motor drive controller of the invention is able to operate the chain hoist 10 with far greater sensitivity and much tighter control than is possible using conventional systems.

It has proven advantageous, however, to also provide the chain motor drive controller with an encoder responsive circuit 70 that employs operational amplifiers and differential signal photo transistors to form an opto-isolation module that monitors the position of the motor 20 when it is at zero speed. That is, the circuitry of the encoder responsive circuit 70 in effect looks ahead and "grabs" the motor 20 and overrides the tracking controller 54. It operates the alternating current drive controller 60 so as to stabilize and hold the chain drive motor 20 at zero speed until or unless the tracker control 54 receives new destination signals from the remote computer. The encoder responsive circuit 70 prevents the drive shaft 22 of the motor 20 from slipping once the motor driving signals from the tracker control 54 command the motor 20 to stop all movement.

In the preferred embodiment of the invention illustrated, the isolation amplifier and converter circuit 58, also labeled as a "GO" ISOLATION MODULE in FIG. 4B is coupled to receive the digital electrical encoded motor driving signals from the tracking controller 54 on line 88. The isolation amplifier and converter circuit 58 is employed to provide compatibility between the digital signals received from the tracker controller 54 on line 88 and the input signals that are required for operation of the alternating current drive circuit 60. More specifically, the digital "hi" or "low" driving signals on line 88 are transmitted to an optical isolation logic circuit that turns an LED on and off. The illumination from the LED is received by a photosensitive transistor, which in turn generates or terminates power or "GO" signals on line 90 to the alternating current drive circuit 60. The generation of a signal on line 90 causes closure of contacts in the alternating current drive circuitry 60. The isolation and amplifier converter circuit 58 thereby provides the necessary actuation, or terminates the actuation of the alternating current drive circuit 60 at the level determined by the output of the digital-to-analog converter circuit 56 on line 83.

In the embodiment of the invention illustrated in FIGS. 4A and 4B the chain hoist motor 20 is provided with a brake 62 that is operated by the alternating current drive circuit 60 through brake relays on the brake relay circuit card 64. A reactor circuit 66 that includes three inductors is coupled between the brake and power plug 76 and the alternating current drive circuit 60. These inductors smooth out the signals and filter harmonics in the operation of the brake 62. The alternating current drive circuit 60 is a "torque proving" drive circuit. That is, the alternating current drive circuit 60 makes sure that the motor 20 is energized before it allows release of the pads of the brake 62.

Figure 5A:
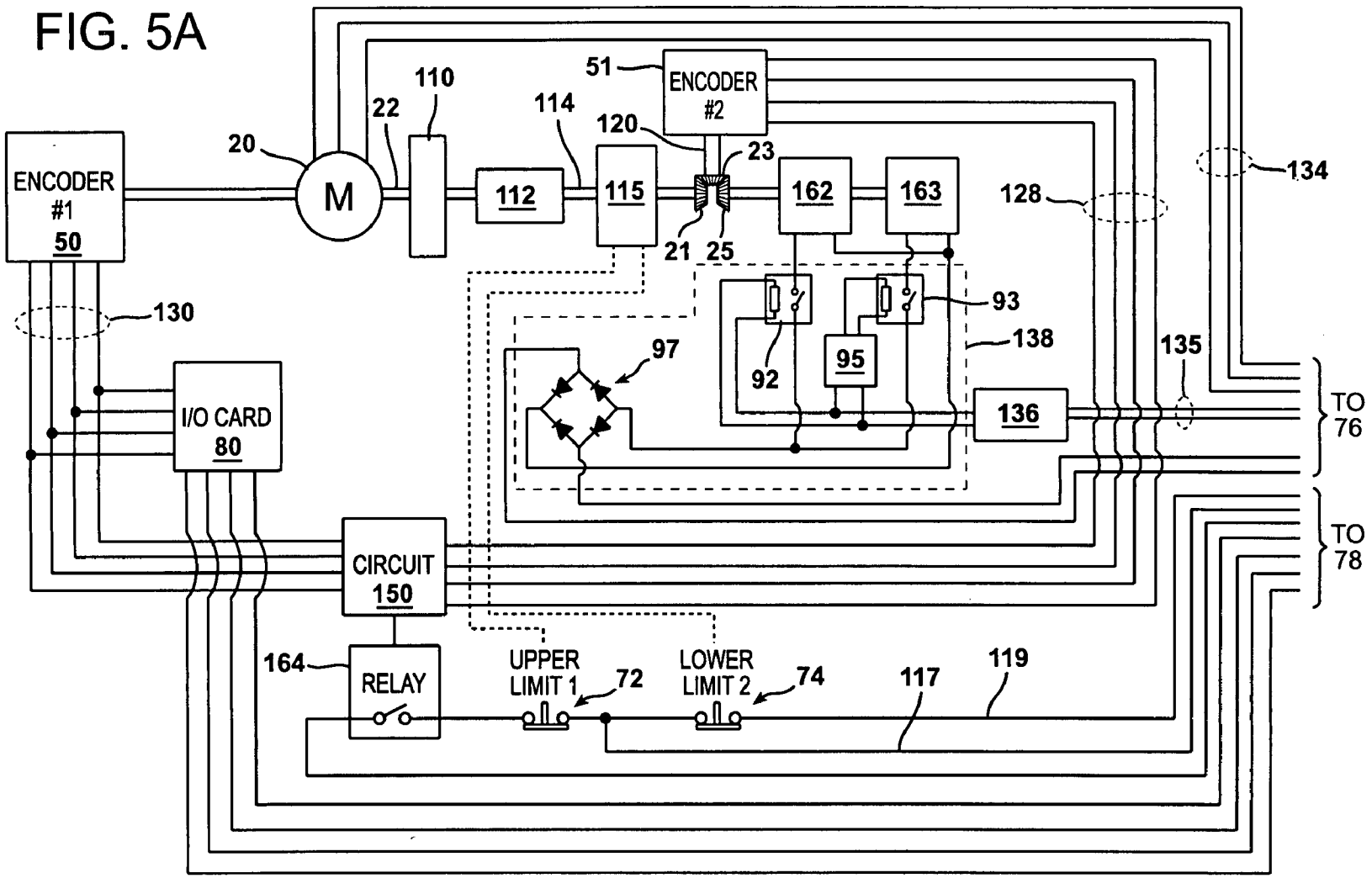
FIG. 5A is an electrical schematic diagram of one portion of the electrical circuitry of an alternative embodiment of a chain motor drive controller of the invention.
Figure 5B:
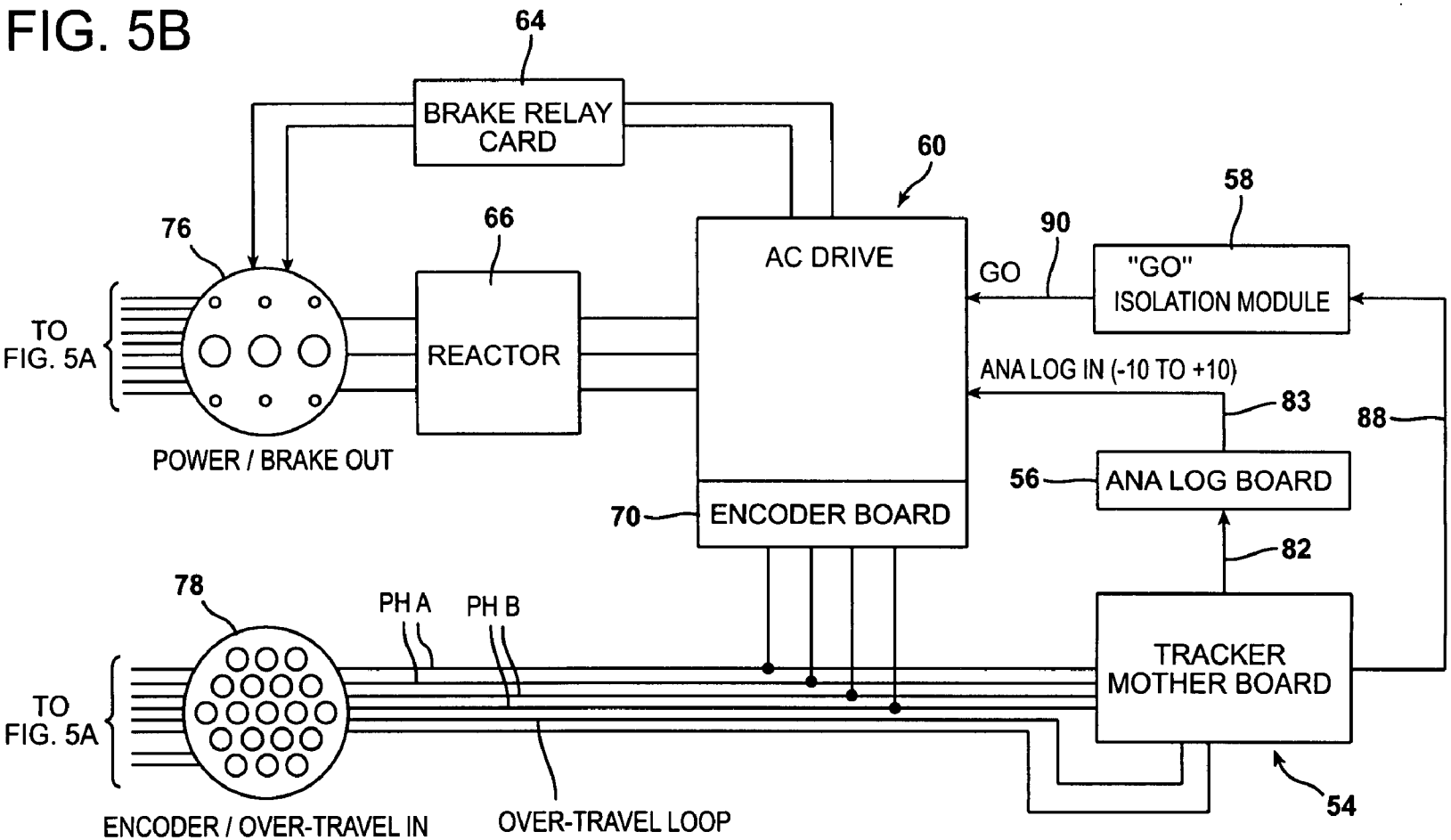
FIG. 5B is an electrical schematic diagram of the remaining portion of the alternative embodiment of the chain motor drive controller of the invention of FIG. 5A.

FIGS. 5A and 5B illustrate an alternative embodiment of the invention in which a pair of motor brakes 162 and 163 are employed. The embodiment of the chain motor drive controller illustrated in FIGS. 5A and 5B employs many of the same features and components as the embodiment of the chain motor drive controller illustrated in FIGS. 4A and 4B. Chain motor drive controller components employed in the embodiment of FIGS. 5A and 5B that are also found in the embodiment of FIGS. 4A and 4B are identified by the same reference numbers.

In the chain motor drive controller illustrated in FIGS. 5A and 5B a slip clutch 110 is connected to the rotary drive output shaft 22 and is coupled to a speed reduction gearbox 112. The output of the speed reduction gearbox 112 is connected to a chain drive output shaft 114. The chain drive output shaft 114 directly drives the chain-engaging mechanism within the casing 12 and also is coupled to a limit switch actuator 115.

The limit switch actuator 115 may be a conventional limit switch mechanism for operating the upper limit switch 72 and the lower limit switch 73. For example, the limit switch actuator 115 may be formed by a pair of nuts threadably engaged at longitudinally separated locations on a threaded shaft that is driven in rotation by the chain drive output shaft 114. As the threaded rod is rotated, the upper and lower limit switch actuating nuts are driven in one direction longitudinally along the threaded rod by rotation of the motor rotary drive shaft 22 in one direction and in an opposite direction longitudinally along the rotating threaded rod when the rotary drive shaft 22 is counterrotated in the opposite direction. When the motor 20 is actuated to lift a load, the threaded rod is driven so that the limit switch actuator for the upper limit switch 72 approaches and then actuates the upper limit switch 72 when the motor 22 has been operated to rotate the rotary drive shaft to lift the load to a maximum allowable height. Conversely, when the motor 20 is operated so that its rotary drive shaft 22 is rotated in the opposite direction to lower the load, the other limit switch actuating nut is driven along the rotating threaded rod to actuate the lower limit switch 74 at the lower, opposite limit of rotation of the motor shaft 22. If either the upper limit switch 72 or the lower limit switch 74 is opened, actuating power on the brake release line 117 is terminated.

The chain hoist controller system illustrated in FIGS. 5A and 5B employs first and second direct current powered brakes 162 and 163. The gearbox chain drive output shaft 114 terminates in a dual output T-connection that drives an encoder input shaft 120 and also a brake shaft 122 through a bevel gear drive interface employing meshed bevel gears 21, 23, and 25 as indicated diagrammatically in FIG. 5A.

A second, chain drive output encoder 51 is coupled to the chain drive output shaft 114 through the encoder input shaft 120. The chain drive output encoder 51, like the position encoder 50, includes another position sensor 48 that may be either a magnetic or optical encoder, just like the position sensor 48 employed in the position encoder 50. The chain drive output encoder 51 produces encoded electrical chain drive output signals on signal lines 128 in response to rotation of the chain drive output shaft 114.

The chain hoist controller illustrated in FIGS. 5A and 5B also includes an encoder mismatch detection circuit or comparator circuit 150 that is coupled to receive the encoded electrical position signals on signal lines 130 from the position encoder 50, and also the electrical chain drive output signals from the second chain drive output encoder 51 on the signal lines 128. Because the encoded input shaft 120 is driven at a reduced speed from the rotary drive shaft 22 due to the speed reduction gears in the gearbox 112, the encoded electrical chain drive output signals on signal lines 128 will be produced in direct proportion to the signals on signal lines 130 from the first position encoder 50, as determined by the ratio of speed reduction of the gearbox 112.

The encoder mismatch detection circuit or comparator circuit 150 is coupled to receive the encoded electrical position signals on signal lines 130 and the encoded electrical chain drive signals on signal lines 128. The comparator circuit 150 is connected to a relay 164, which is coupled in circuit to power signal lines 117 and 119 that are connected to the nineteen-pin signal plug 78 visible in FIG. 1 and indicated schematically in FIG. 5B.

The relay 164 is normally closed. However, in the event of a signal mismatch between the output signals from the encoders 50 and 51, the relay 164 will open, thereupon producing signals through the nineteen-pin signal plug 78 that result in termination of the power signals on lines 134 to the chain drive motor 20.

Furthermore, once the motor drive termination signal is produced by closure of the relay 164, the external computer initiates sequential operation of the brakes 162 and 163. Specifically, once the comparator circuit 150 has closed the relay 164, the signals on lines 135 are terminated. The signal lines 135 are connected to an isolated brake release circuit board interface circuit 136, which, in turn, is coupled to a brake delay module indicated at 138.

In a preferred embodiment of the invention the brake delay module 138 is comprised of circuit components already present in the chain hoist 10. Specifically, the brake delay module 138 may be considered to be the brake relays 92 and 93, respectively connected to the first brake 162 and second brake 163. The brake delay module 138 also includes an off-time delay circuit 95 that is coupled to the brake relay 93, but not to the brake relay 92. The brake delay module 138 may also be considered to include the two hundred eight volt AC to one hundred eighty volt DC rectifier bridge 97 that provides DC power to the first brake 162 and second brake 163 through the relays 92 and 93, respectively.

The embodiment of the chain motor drive controller illustrated in FIGS. 5A and 5B is configured so that the brake delay module 138 forms brake relay circuitry for sequentially applying the first motor brake 162 and the second motor brake 163 at a delayed time interval apart. Specifically, when the signals on the brake control signal lines 134 driving the motor 20 are removed, the termination of signals on brake control lines 135 causes the brake relay 92 to close immediately, thereby clamping the first brake 162 on the brake shaft 122. Since the brake shaft 122 is rigidly coupled through the bevel gears 21, 23, and 25, to the chain drive output shaft 114, the chain drive output shaft 114 can no longer rotate. Each of the brakes 162 and 163 is capable of preventing rotation of the chain drive output shaft 114. Application of either the first brake 162 or the second brake 163, or both of the brakes 162 and 163, likewise prevents rotation of the bidirectional chain drive motor 20. The brake delay module 138 thereby sequentially applies the first brake 162, and then the second brake 163, in response to the brake-actuating signal produced by the encoder mismatch detection circuit 150. The chain drive output shaft 114 will not rotate until both of the brakes 162 and 163 are released.

The off time delay circuit 95 is set to introduce a sufficient delay in actuation of the second brake 163 after actuation of the first brake 162 so that the audible sounds created by the application of these two brakes 162 and 163 can be distinguished from each other. That is, the time delay circuit 95 preferably actuates the second brake 163 at least 0.5 seconds, and preferably about 1.0 second after the first brake 162 is actuated.

The comparator circuit 150 is coupled to receive the encoded electrical position signals on signal lines 130 and the encoded electrical chain drive output signals on signal lines 128 to produce a brake-actuating signal to the relay 164 in response to a predetermined permissible difference in the relationship between the outputs of the encoders 50 and 51. The isolated brake release circuit board interface circuit 136, through the brake delay module 138, sequentially applies the first brake 162 and the second brake 163 in response to the brake actuating signal to the relay 164. The brakes 162 and 163 are not released until different destination signals are provided to the computer that is connected to the control system of the invention by signal lines entering the chain hoist 10 through the nineteen-pin plug 78.

Undoubtedly, numerous variations and modifications of the invention will become readily apparent to those familiar with chain motor drive controllers. Accordingly, the scope of the invention should not be construed as limited to the specific embodiment depicted and described, but rather is defined in the claims appended hereto.

I claim:

1. In a chain hoist having a casing with a bidirectional chain drive motor that has a rotary drive shaft housed therewithin, the improvement comprising:

a position encoder located within said casing including a position sensor producing encoded electrical position signals in response to rotation of said drive shaft, and tracking circuitry located within said casing for receiving electrically encoded destination signals from a source located externally of said casing and for receiving said encoded position signals, and providing electrical encoded motor driving signals responsive to differences between said encoded position signals and said encoded destination signals, and wherein said motor driving signals accelerate rotation of said chain motor drive shaft starting from a stationary condition and decelerate rotation of said chain motor drive shaft as said differences between said encoded position signals and said encoded destination signals approach zero, further comprising:

a chain drive output shaft, a slip clutch connected between said motor rotary drive shaft and said chain drive output shaft, a chain drive output encoder coupled to said chain drive output shaft and including a chain drive output sensor producing encoded electrical chain drive output signals in response to rotation of said chain drive output shaft, an encoder mismatch detection circuit coupled to receive said encoded electrical position signals and said encoded electrical chain drive output signals and to produce a brake actuating signal in response thereto, at least one motor brake for preventing rotation of said bidirectional chain drive motor, and a brake relay circuit for applying said motor brake in response to said brake actuating signal.

2. A chain hoist according to claim 1 further comprising:

first and second motor brakes as aforesaid, each of which is capable of preventing rotation of said bidirectional chain drive motor, and wherein said brake relay circuitry sequentially applies said first and second motor brakes a delayed time interval apart.

3. A chain hoist according to claim 1 further comprising:

first and second motor brakes as aforesaid, and wherein said brake delay circuit is coupled to said first and second motor brakes and operative responsive to said brake actuating signal to apply said first brake to said rotary drive shaft and only after a time delay interval then apply said second brake to said rotary drive shaft.

4. A chain hoist according to claim 3 wherein said first and second brakes each produce an audible sound when applied to said rotary drive shaft, and said time delay interval is long enough so that said audible sounds produced by said first and second brakes are audibly distinguishable from each other.

* * * * *